US009565946B1

(12) United States Patent
Watton

(10) Patent No.: US 9,565,946 B1
(45) Date of Patent: Feb. 14, 2017

(54) PARK BENCH

(76) Inventor: Jeffrey Watton, Chippewa Falls, WI (US)

( * ) Notice: Subject to any disclaimer, the term of this patent is extended or adjusted under 35 U.S.C. 154(b) by 176 days.

(21) Appl. No.: 13/364,124

(22) Filed: Feb. 1, 2012

(51) Int. Cl.
*A47C 7/02* (2006.01)
*A47C 7/40* (2006.01)

(52) U.S. Cl.
CPC ..... *A47C 7/405* (2013.01); *A47C 7/024* (2013.01)

(58) Field of Classification Search
CPC ..... A47C 7/405; A47C 7/024
USPC ..... 297/452.63
See application file for complete search history.

(56) References Cited

U.S. PATENT DOCUMENTS 398,179 A * 2/1889 Parry et al. ..... 297/452.63 X
684,403 A * 10/1901 Benedict ..... 297/452.63 X
1,192,941 A * 8/1916 Schmid ..... 297/452.63
1,260,962 A * 3/1918 Bulmer ..... A47C 17/12 297/452.63 X
2,016,953 A * 10/1935 Arnold ..... 297/452.63
6,036,273 A * 3/2000 Lin ..... 297/452.63
6,739,671 B2 * 5/2004 De Maina ..... B60N 2/7011 297/440.21 X
D498,079 S 11/2004 Messier
D523,263 S 6/2006 Skalka
7,066,553 B2 * 6/2006 Maloney ..... 297/452.63 X
D526,805 S 8/2006 Skalka
7,226,130 B2 * 6/2007 Tubergen et al. ..... 297/452.52
8,262,157 B2 * 9/2012 Novak ..... 297/452.63 X

* cited by examiner

*Primary Examiner* — Anthony D Barfield
(74) *Attorney, Agent, or Firm* — Anthony J. Bourget

(57) ABSTRACT

A bench and frame component for holding individual planks to be used in a sitting bench where fastening an individual plank to the frame can be avoided. The frame is configured to allow a plank to be received in a holding pocket defined by an upper pocket piece and a lower pocket piece. The upper pocket piece may be connected to and removed from the lower pocket piece. The lower pocket piece may include a series of pocket segments and when connected with the upper pocket piece form a series of two-piece holding pockets for receiving a plurality of planks. The frame component is combined with other components and planks to form a bench. The bench may comprise individual bench sections that connect with similar modular sections to form a sectional bench.

22 Claims, 17 Drawing Sheets

PARK BENCH

BACKGROUND OF THE INVENTION

The present inventive concept relates generally to seating devices and benches, including park benches.

Several devices are known that allow people to assume a comfortable sitting position, and benches, such as park benches, have been available over the years in many varieties. A typical bench includes a seating area and an optional backrest area. In one variety a bench typically includes a plurality of planks positioned between a pair of side supports which suspend the planks from the ground to form a seating surface. Each side of a plank is fastened or bolted to opposing supports.

Another park bench is shown in the design of Messier, U.S. D498,079. In Messier the bench includes a pair of side supports receiving a plurality of planks. Messier also includes a cross bar extending between the pair of side supports and beneath the planks. The bench of Messier also includes planks that generally form a back rest of the bench. There are many other varieties of benches, and many sub-varieties that include armrests or other components, whether structural, cosmetic, or both. There are many different styles of benches varying in use and popularity. While the foregoing and other benches are beneficial, there is always room for improvement.

SUMMARY OF THE INVENTION

The present inventor has recognized that the manufacture, assembly, repair, and maintenance of a typical bench is troublesome. In many or most instances, each individual plank is fastened or bolted between a pair of supporting legs. This requires manufacture of several parts to secure the planks, and a great deal of time to assemble all of them onto the supports. If the planks need to be replaced or repaired, then a worker must remove the associated hardware in order to lift an individual plank, or several planks, from the supports. The fasteners are often exposed, thus potentially resulting in unwanted wear and tear or unauthorized disassembly or unwanted snagging or interference with enjoyable use of the bench. Further, having the individual planks fastened tightly to a pair of supports makes the planks relatively rigid. One object of the present invention is to avoid having to individually fasten each of the planks to a support of the bench. Benches which have the individual planks fastened to a support are sometimes considered uncomfortable compared to benches that have planks that adjust or flex (i.e., where a fastener is not inserted into a plank to fasten the plank to a frame or support). Accordingly, in one aspect the invention includes use of support pockets into which the ends of planks may be inserted and flexibly retained in position (i.e., the planks are allowed some flexibility to move since a fastener does not pass through the plank or the plank is not clamped into position). The individual planks can thus be used without drilling holes (eliminating labor and tendency of a plank to rot).

Where a plank is inserted into a pocket of a support such that a fastener does not pass through the plank or the plank is not clamped into position, the plank may be free to adjust or flex. Even so, in cases where the planks are inserted within respective pockets of a support, assembly of the planks within the supports can be troublesome where the planks, having equal lengths, cannot be individually inserted into the side pockets of the supports; rather, it is required that the ends of the several planks be simultaneously inserted into pockets of a support. This requires holding the multiple ends in position while also sliding all of the planks into pockets of the support. Further, in order to remove a single plank (such as for replacement or repair), it is appreciated that all or substantially all of the planks are likely required to be removed from the support. This is because the support which forms the pocket holding the several planks must be removed, causing all of the planks to be removed from their respective pockets. Instead, the present invention allows for removal of a single plank without disrupting the positioning of any of the other planks. This is accomplished by use of a modifiable pocket, where removal of a portion of the pocket, such as when removing one of the pocket pieces of a two-piece pocket, allows for an individual plank to be removed/inserted. The two-piece pocket also allows for swift assembly of the bench since the individual planks may be simply placed into position without use of separate fasteners or any special clamping.

The present invention also includes modular versatility not found in other seating appliances or benches. The modularity allows for a bench to have an infinite or indefinite length. A repeating sequence of a standard unit may be assembled such that benches measuring lengths of 4 feet, 6 feet, 8 feet and beyond may be assembled in series or multiple series to create any desired length of bench. The support or base pieces are symmetrical and may operate as either left or right supporting ends of the bench or as intermediate supports between sections. Typically a bench comes in a standard length as a stand-alone structure. In the present invention additional tubes and planks may be inserted into the end of an already assembled bench of like variety. By including at least one more end support, the added tubes and planks operate to extend the length of the sectional bench. The support or base portions of the bench are configured to simultaneously receive tubes and planks on both side of the base. The base portions include ribs and inner walls that prevent a plank or a tube from extending too far within a pocket or a hub, respectively, to assure sufficient alignment. Particularly, when connecting two tubes at either end of a common hub, a user would have uncertainty as to whether one or both of the tubes was sufficiently secured within the hub or socket. Use of the inner wall structure within a socket of the present invention allows a user to assure that each tube placed in opposite ends of the socket of a support has been sufficiently threaded upon a turning or threaded rod within the socket. Further, use of ribs on a support assures that sufficient surface area is available for forming pockets on either side of a base or support of a bench to support receiving planks in pockets on either side of the base or support. The same end frame component receives and supports planks extending from each side of the end frame component, allowing the bench to be expanded by adding additional planks end-to-end.

The present invention also includes versatility in use of center pieces or armrests. An armrest structure may be positioned between end supports. The armrest structure may slide along the length of the bench to accommodate different choices. In one aspect multiple armrest may be included between supports of a standard bench. In this way the benches may be configured for theater-type seating. Alternative center pieces may include a simple crown or cap that does not include an armrest.

The present inventor has recognized that securing tubes end-to-end within a socket/hub or in such a way that the hollow tubes are sealed would tend to cause the tubes or other components to deteriorate or loosen over time. Particularly, the inventor appreciates that if a tube is sealed, even temporarily, or if air or gasses within a tube are not allowed to flow freely, then pressure and humidity differences may develop within the structural system. Were the ends of a tube sealed within hubs or sockets of the supports, the temperature and pressure differences, together with humidity factors may tend to corrode or deteriorate the components. Accordingly, venting features have been included within the hubs of the base to allow for the free-flow of air through the tube elements of the bench. The venting features include passages built into the socket structure so that air from the environment may flow into the tubes, and vice versa.

Heretofore unrelated to the use of a seating structure or bench is the use of a holding pocket for receiving a plank where the pocket is defined by two-pieces. The holding pockets may be conveniently altered or opened to allow an end of a plank to be inserted into the pocket. The holding pocket allows for flexible action at the ends of the planks for a comfort sitting and back rest structure. The split holding pockets also allow for easy assembly, repair and maintenance of the individual planks. A user may be creative in the display of the bench since the individual planks may be replaced efficiently. Advertisements or donor recognitions may be included directly on the planks and then modified by making simple replacements of the planks. The color schemes or look and feel of the individual planks may be mixed and matched and readily re-mixed and matched as desired. The split action of the holding pockets also allows for the quick and efficient removal of armrests to be replaced with crowns or caps, or vice versa. The configuration of the supports which operate as the two-piece holding pockets allow for modular expansion to create a series of bench sections of any desired length. The venting features promote durability and long-life of the products. These and other objects of the invention are presented in further detail below.

The above summary of the present invention is not intended to describe each illustrated embodiment, aspect, or every object or implementation of the present invention. The figures and detailed description that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which:

FIG. 17 is a reverse perspective view of the sectional bench of FIG. 16.

Figure 1:
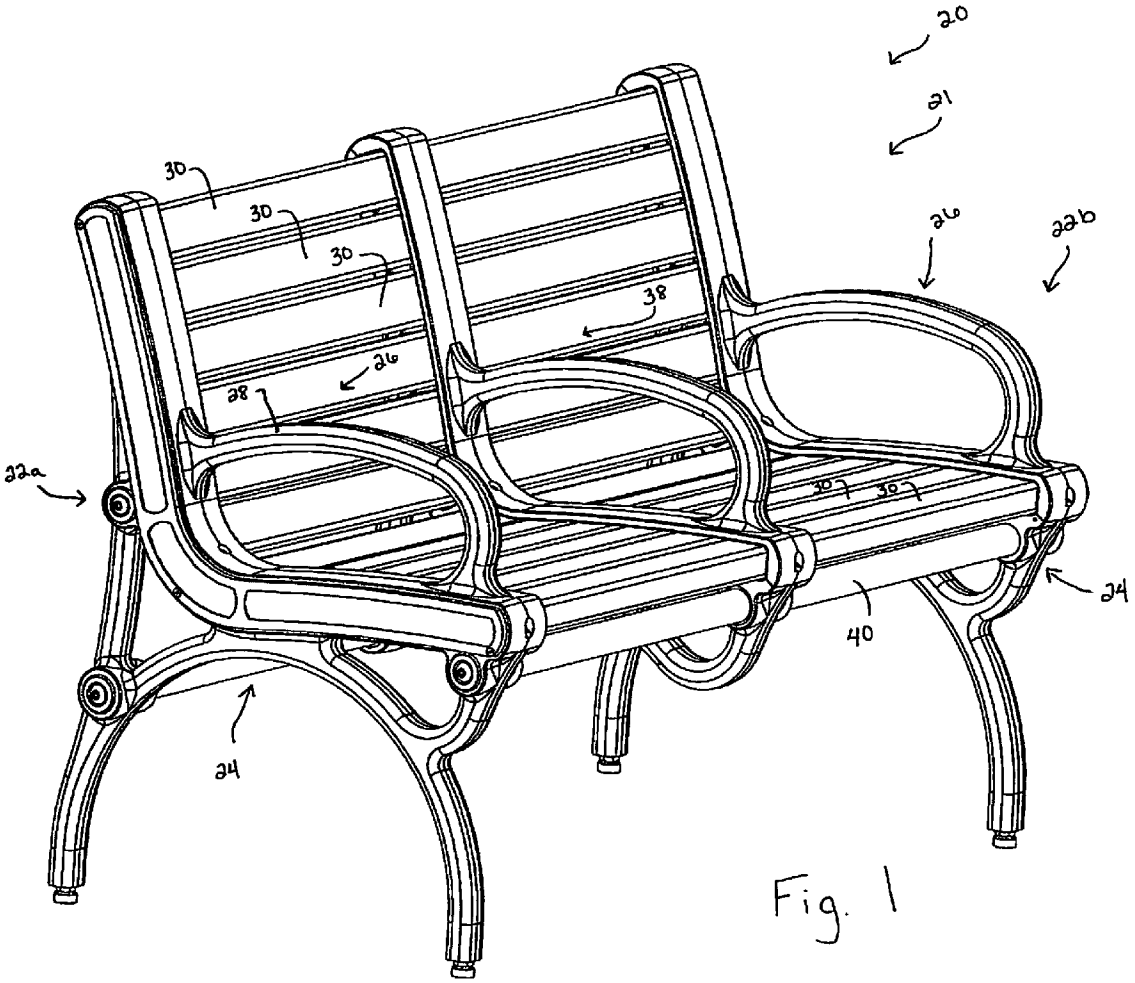
FIG. 1 is a perspective view of a bench according to one aspect of the invention.

While the invention is amenable to various modifications and alternative forms, specifics thereof have been shown by way of example in the drawings and will be described in detail. It should be understood, however, that the intention is not necessarily to limit the invention of the particular embodiments described.

DETAILED DESCRIPTION OF THE INVENTION

The following detailed description is not to be taken in a limiting sense, but is made merely for the purpose of illustrating the general principles of the invention, since the scope of the invention is best defined by the appended claims.

Figure 2:
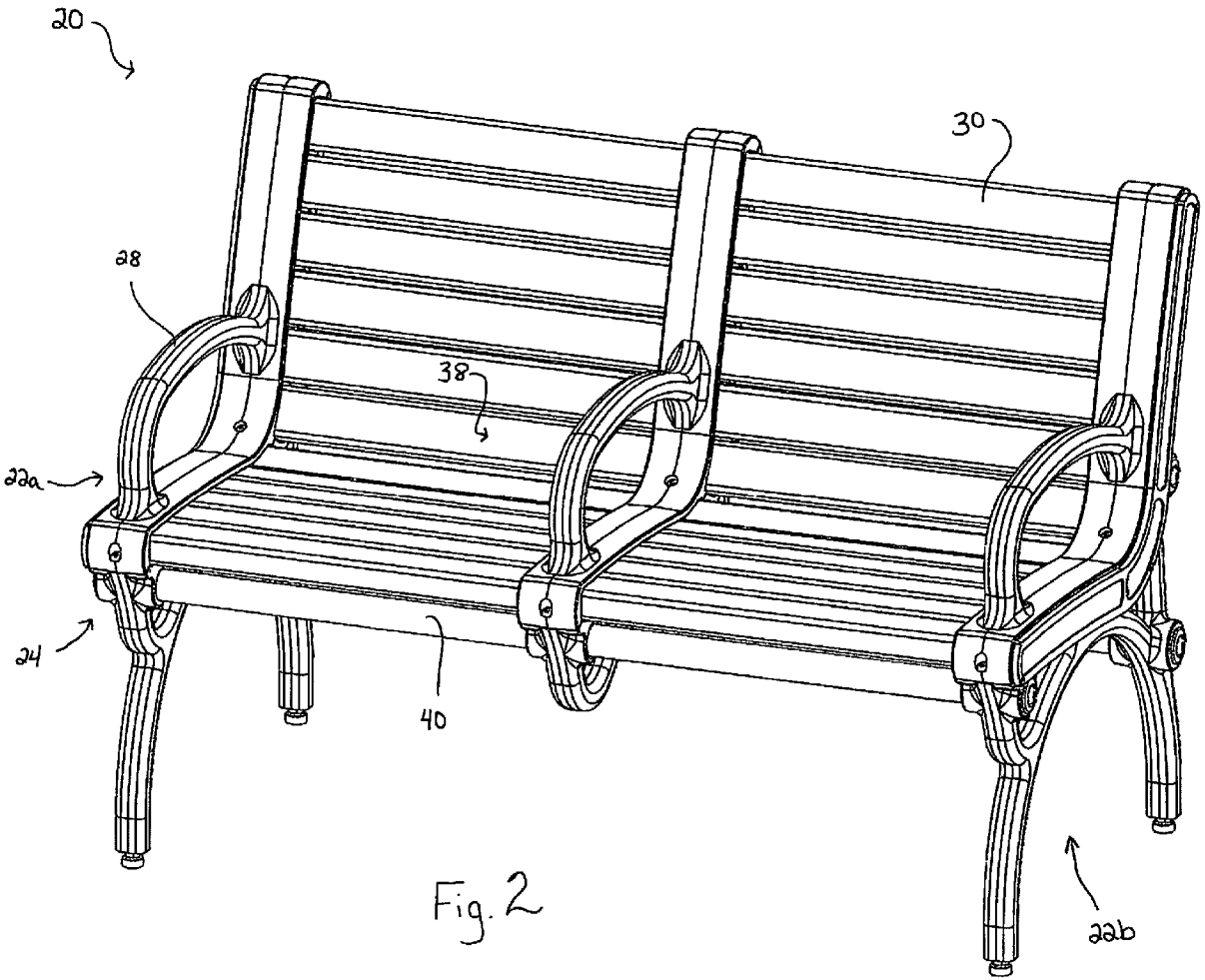
FIG. 2 is a reverse angle perspective view of the bench of FIG. 1.

One aspect of the present invention generally provides a bench 20 depicted in FIG. 1. FIG. 2 is a reverse angle perspective view of bench 20 shown in FIG. 1. Bench 20 is preferably a sitting bench and includes support 22*a* and support 22*b* on opposite ends of bench 20. Planks 30 and tubes 40 are positioned between supports 22. Supports 22 (further described below and with respect to FIG. 3, FIG. 4 and FIG. 5) may be made of any material but are preferably made of metal and preferably are of caste aluminum (including 100% recycled U.S. aluminum). Supports 22 are preferably identical pieces and may be used interchangeably. For instance support 22*a* may be used as either a left-side support as shown in FIG. 1 or as a right-side support. Bench 20 shown in FIG. 1 and FIG. 2 is a standard four foot bench having an optional inside armrest structure 38. It may be appreciated that planks 30 and tubes 40 may be of greater or lesser length to increase the length of bench 20. Bench 20 as shown is a single section bench 21. As described below with respect to FIG. 16, bench 220 may include multiple sections 21 by joining together multiple benches 20 or components of bench 20 in modular fashion.

Figure 3:
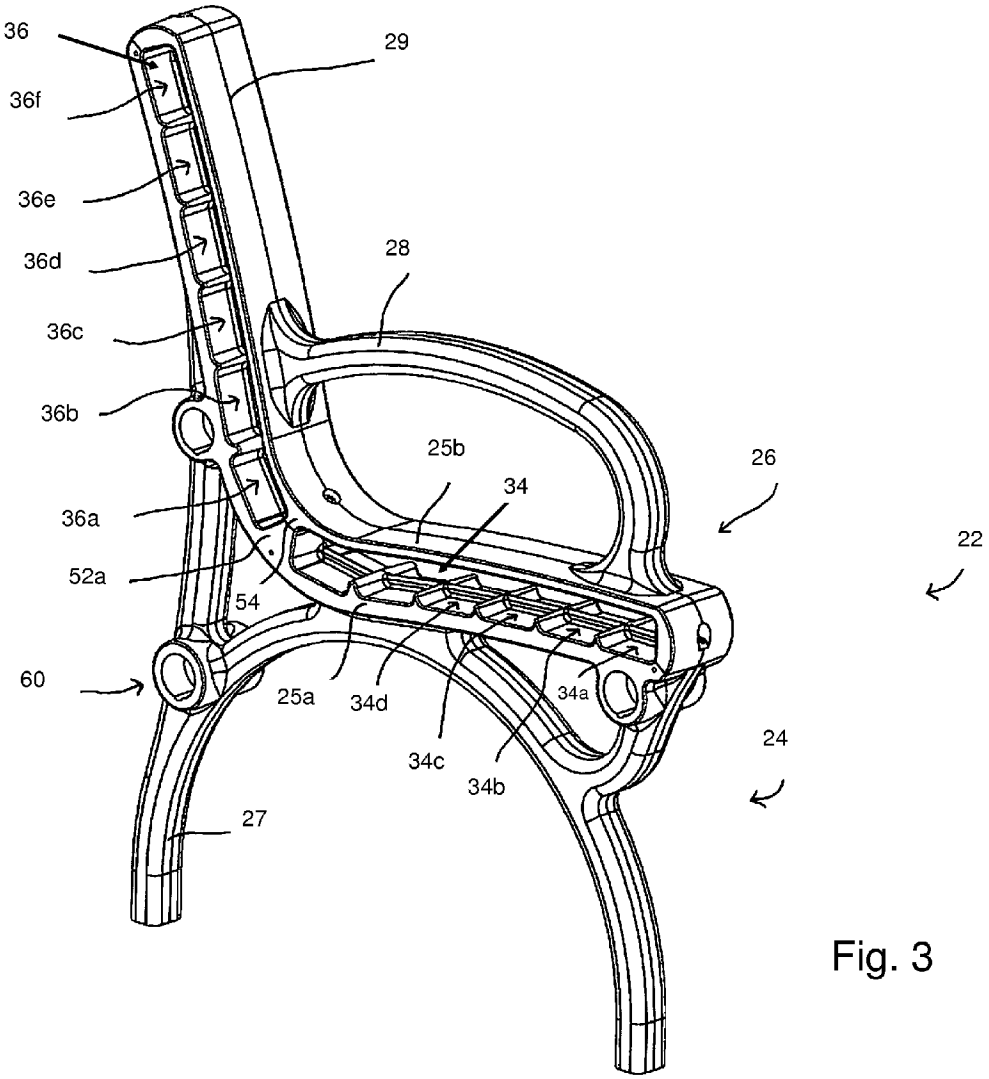
FIG. 3 is a perspective view of a support feature of the bench of FIG. 1.
Figure 4:
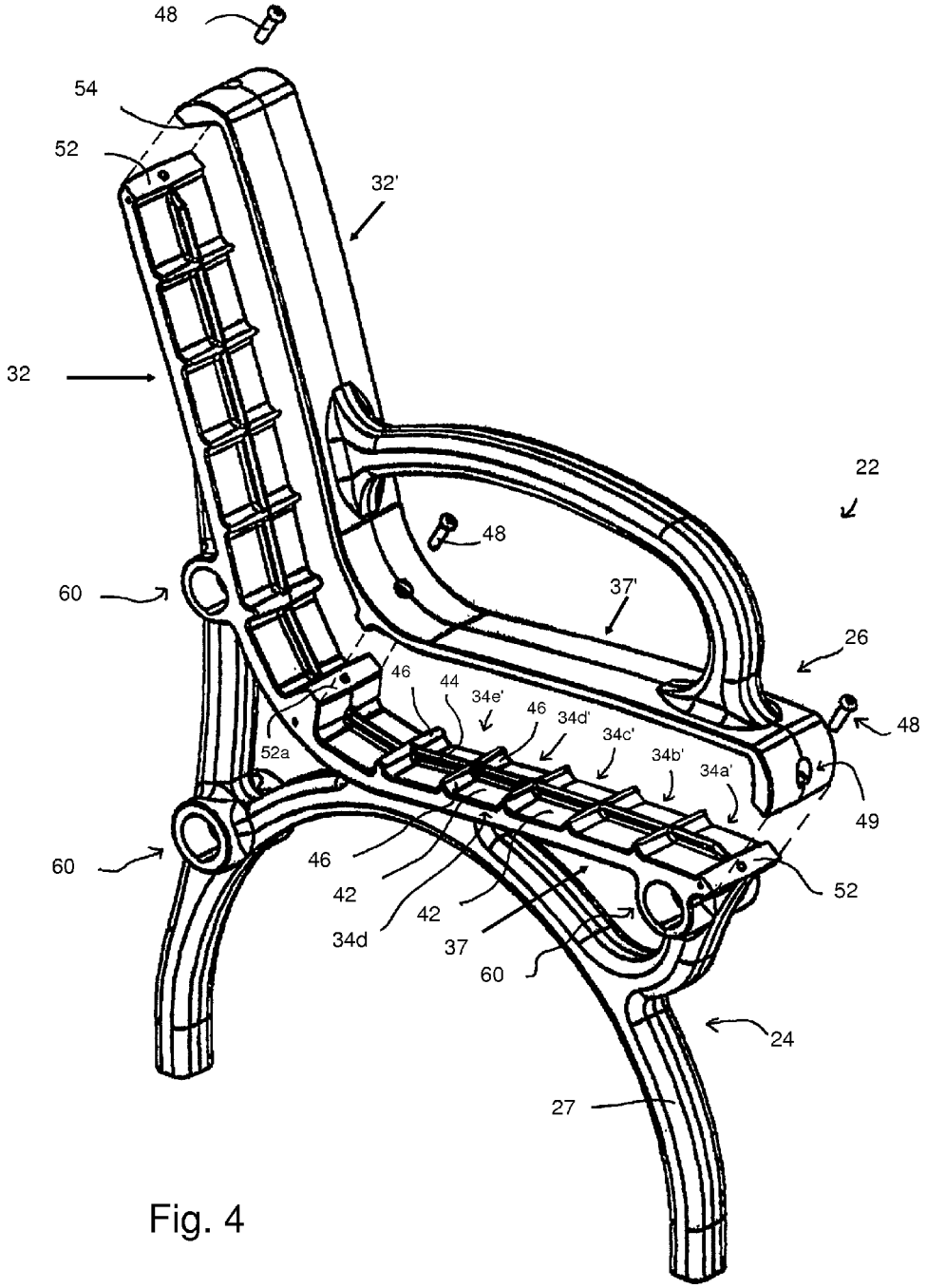
FIG. 4 is an exploded perspective view of the feature of FIG. 3.

An important aspect of bench 20 includes support 22 which is a two-piece support. More particularly, support 22 includes a base 24 and a corresponding cap 26. A cap 26 and base 24 are typically made from a two piece mold where parting line 29, for instance, results from the removal of the piece from the mold. Parting line 29 is only minimally visible and is typically covered in the finished product with a powder coating or paint if desired. As shown in FIG. 3, cap 26 and base 24 are connected. FIG. 4 shows cap 26 detached from base 24. Cap 26 and base 24 connect to form a plurality of holding pockets 34 and 36. Particularly, a holding pocket 34, such as pocket 34*a* is defined at least in part by a first pocket piece 25*a* and a second pocket piece 25*b*. Preferably pocket piece 25*b* is detachable from pocket piece 25*a*. Preferably pocket piece 25*a* and pocket piece 25*b* define a plurality of holding pockets such as holding pockets 34*a*, 34*b*, 34*c*, 34*d*, 34*e*, 34*f*. It may be appreciated that fewer or greater holding pockets may be formed to accommodate holding of a fewer or number of planks. As may be appreciated, pocket piece 25*a* is a seating pocket segment generally oriented along a seating plane. The holding pockets 34 are configured to hold planks of seating. Holding pockets 36, such as holding pockets 36*a*, 36*b*, 36*c*, 36*d*, 36*e*, 36*f* are configured to receive planks 30 which generally form a backrest of bench 20. It may be appreciated that fewer or greater holding pockets 36 may be formed. Backrest pocket segments 36 generally orient along a backrest plane. As shown in FIG. 4, base 24 includes a seat portion 37 and a back portion 32. The back portion 32 is raised with respect to seat portion 37. In one aspect back portion 32 is integrally connected to seat portion 37. Cap 26 includes a seat portion 37' and a back portion 32'. The back portion 32' is raised with respect to seat portion 37'. In one aspect back portion 32' and seat portion 37' are integrally connected. Each holding pocket 34, 36 is configured to receive an end of a plank 30. A plurality of planks 30 inserted into holding pockets 34 of opposed supports 22*a*, 22*b* form a seating structure oriented generally along a seating plane. The seating plane may be oriented along a generally horizontal plane. A plurality of planks 30 inserted into holding pockets 36 of opposed supports 22*a*, 22*b* form a backrest structure oriented generally along a backrest plane. Backrest plane is generally oriented at an obtuse angle with respect to seating plane as shown generally in FIG. 1. It may be appreciated that in an alternative aspect bench 20 may be configured without a backrest structure.

A plank 30 may be of any material including but not limited to wood, plastic, composite (including polyvinyl extruded studs), High Density Polyethylene (HDPE) studs, metal, or a combination of materials. Preferably planks are made of a durable plastic material that requires minimal maintenance. Planks 30 may be of any desired length but preferably are segments of common variety for use on bench sections 21 of varying lengths (i.e., 4, 6, 8 or 10 foot length sections 21 would by typical). Planks 30 do not require holes or clamps or special fasteners for use with bench 20. Planks may be removed swiftly in case of a desired or needed replacement. Wording or designs or other descriptions and insignia may be embedded or printed on planks for donor recognition, advertising, identification or other purposes. The planks may be conveniently switched to change the identifications or messages as noted below. Bench 20 may include any number of planks 30. Applicant has found, however, that bench 20 will preferably include six seating planks 30 and six backrest planks 30 for optimal comfort. It may be appreciated that the backrest component of bench 20 may be optional. The planks 30 shown in FIG. 1 are sized to accommodate a representative four foot length bench 20. While a plank 30 as shown in FIG. 1 may have a cross-section dimension of about 2½ inches by 3½ inches, other dimensions of planks 30 (including standard-cut 2×4 studs) may be used (and corresponding size adjustments made to the components of bench 20) without departing from the spirit of the invention.

With reference to FIG. 4, it may be appreciated that a plank 30 may be positioned within a holding pocket 34 such as at pocket 34*d*. Pocket 34*d* will be used in the following description as representative of the other holding pockets 34 a-f. Plank 30 lies upon plank support face 42. Particularly, and end of plank 30 is positioned upon face 42. Preferably holding pocket 34*d* will be formed in part by an end rib 44. End rib 44 prevents plank 30 from sliding laterally along face 42. More preferably holding pocket 34*d* would include a side rib 46 and another side rib 46. When cap 26 is placed upon base 24, pocket 34*d* will bound an end portion 31 of plank 30 which is positioned between opposing supports 22*a*, 22*b*. Cap 26 holds plank 30 in place. Placing plank 30 within pocket 34*d* allows for plank 30 to have some degree of movement or flexibility within pocket 34*d* since the plank 30 is not fastened to bench 20. Instead, plank 30 within a pocket, such as within pocket 34, will be free to "float" or adjust and conform to the pressures applied to the plank, such as when a person sits upon plank 30 (or leans against a backrest plank 30 positioned within holding pocket 36). Use of pocket 34 allows for ease of assembly of bench 20 since planks 30 do not require holes to be drilled or fasteners to be inserted therein. Use of a plurality of planks within their respective holding pockets 34 accommodates for seating a surface that has an automatic self-adjustment based upon the size and shape of the person sitting on bench 20. Planks 30 tend to conform or flex to the stress or pressures applied to the planks 30 by an individual who sits on bench 20. It may be appreciated that while planks 30 may contribute to the structural support of bench 20, bench 20 may maintain structural integrity without planks 30. Particularly, tubes 40 span between opposing supports 22*a*, 22*b*.

Figure 8:
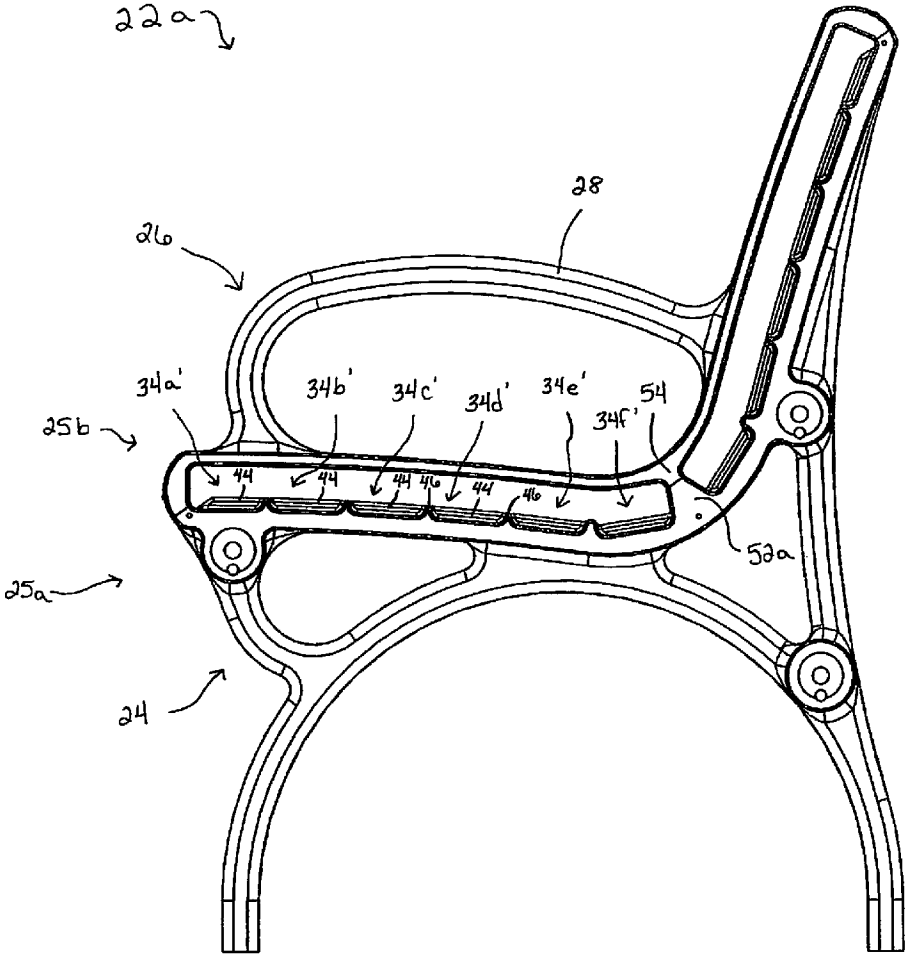
FIG. 8 is a right side view of the support of FIG. 3.

End rib 44 may be positioned at an edge portion of pocket piece 25*a*. More preferably, however, end rib 44 is oriented generally along a longitudinal central axis of pocket piece 25*a* as shown in FIG. 3 and FIG. 4. Having end rib 44 oriented along the central axis allows for a plurality of additional pockets such as holding pockets 34' to be included. Particularly, holding pocket 34*a*', 34*b*', 34*c*', 34*d*', 34*e*', 34*f*', for instance, may be provided. See, for instance, FIG. 8 which shows a right side view and holding pockets 34'. Each holding pocket 34' may receive an end portion 31 (see FIG. 5) of a plank 30. As described further below, a support 22 may accommodate holding planks 30 which extend from either side of support 22. Particularly, a plank 30 may be received in holding pocket 34*d* and span from support 22 to an adjacent second support 22, while holding pocket 34*d*' may receive a different plank 30 and span from support 22 to an adjacent third support 22. Having a face 42 on either side of central rib 44, and together with cap 26, secures planks 30 which extend outward from support 22 in either direction.

As shown in FIG. 4, a fastener 48 (or fasteners 48), such as a security screw or bolt, inserts into port 49 of cap 26 in order to secure cap 26 to base 24 as may be appreciated. A security bolt has a special head which requires a special wrench to fit upon the security bolt in order to turn the bolt. Base 24 preferably includes flange 52 (or flanges 52) having a flange port to receive fastener 48. A cap flange 54 abuts upon flange 52 for secure mounting of cap 24 to base 24. Flange 52*a* is positioned at a middle area of base 24 as shown to receive and connect with cap 26 at a cap flange 54 by use of fastener 48.

Figure 5:
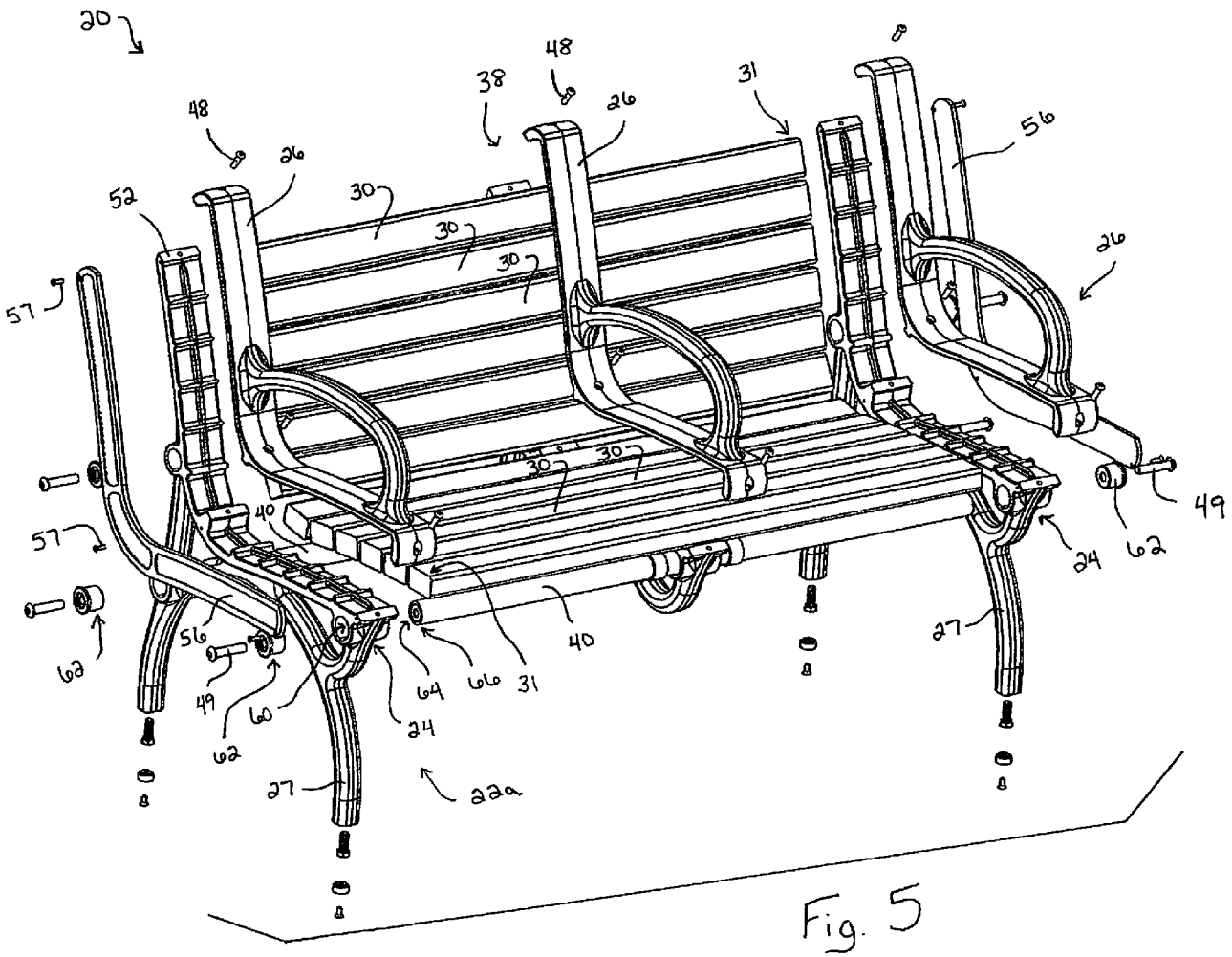
FIG. 5 is an exploded perspective view of the bench of FIG. 1.

FIG. 5 is an exploded perspective view of the bench 20 of FIG. 1. Opposing supports 22*a*, 22*b* are secured together by tubes 40. Preferably there are three tubes 40 that span the distance between supports 22. It may be appreciated that more or fewer tubes 40 may be used, however use of three tubes 40 is preferred. A tube may be made of any material, but is preferably made of steel. Tube 40 inserts within socket 60 which is defined by base 24. Socket 60 is a bore element having inner diameter of a dimension such that socket 60 snugly (or nearly snugly) receives tube 40 which has a slightly smaller outer diameter than the inner diameter of socket 60.

Figure 6:
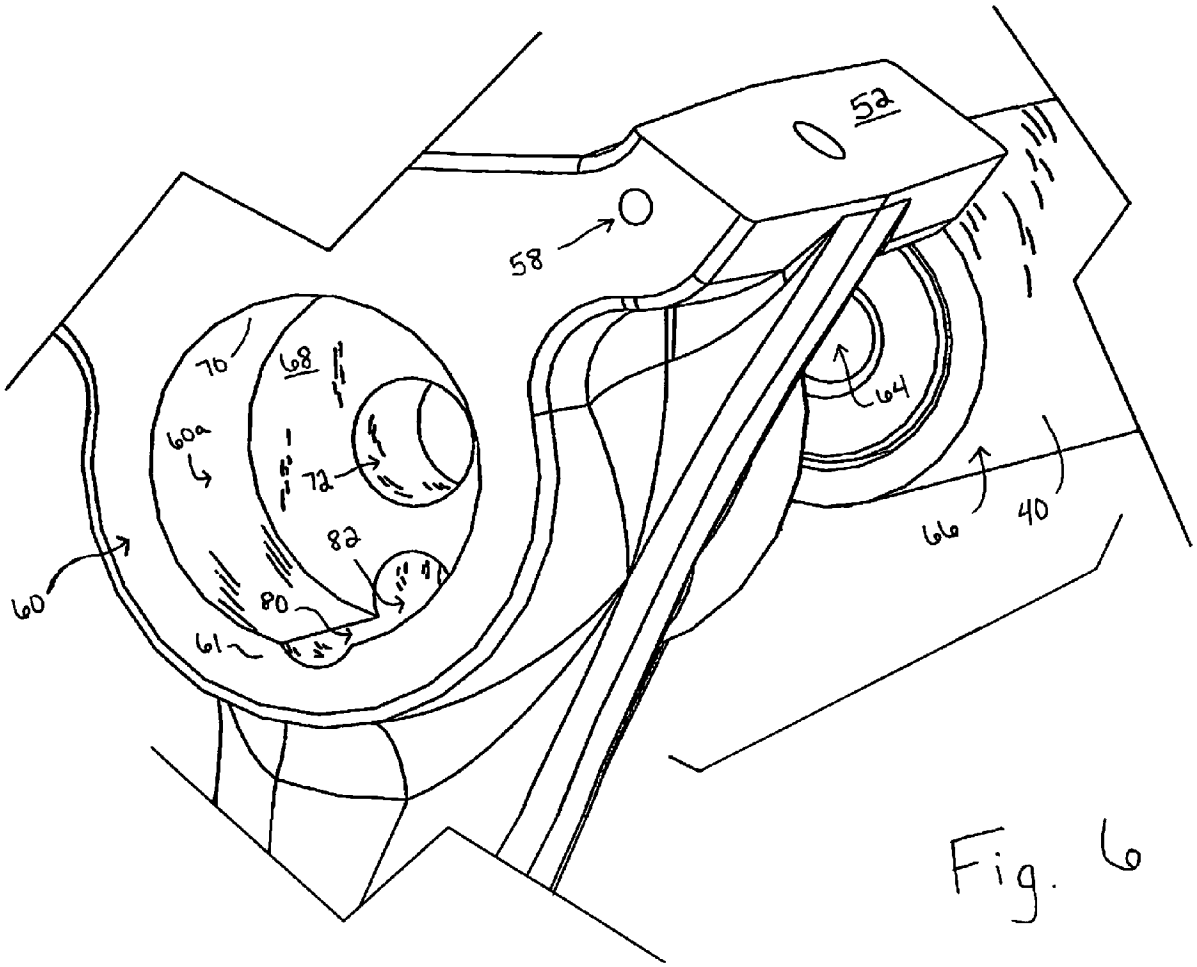
FIG. 6 is a partial exploded perspective view of features of the bench of FIG. 1.

With reference to FIG. 6, a web 68 is provided inside socket 60. Web 68 acts as a wall or barrier to prevent tube 40 from inserting through (or too far into, or not far enough within) socket 60. Web 68 is positioned generally at a center area of socket 60. Such positioning results in socket 60 having a first socket portion 60*a* and a second, opposite socket portion 60*b* separated by web 68. In one example, socket 60 may have a depth of about three inches and web 68 may have a thickness of about ¾ inches. Where web 68 is positioned centrally, this leaves a socket wall 70 (which defines first socket portion 60*a*) having a depth of about 1⅛ inches, and an opposite second socket portion 60*b* having a depth of about 1⅛ inches. Thus, a tube 40 inserted within socket 60 (at socket portion 60*a* or 60*b*, for instance) will abut web 68 such that about 1⅛ inches of tube 40 is inserted within socket 60 and abutting against or fitting adjacent socket wall 70. It may be appreciated that the above dimensions are only one present example and various alternative sizes and dimensions may be used. As may be appreciated and as described below regarding sectional bench 220 (FIG. 16), a tube 40 may insert into socket 60 at the first socket portion 60*a* and another tube 40 may be inserted into socket 60 at a second socket portion 60*b* opposite first socket portion 60*a*.

Tube 40 includes a threaded insert 64 (FIG. 5) positioned at an end portion 66 of tube 40. Threaded insert is preferably welded into position. Insert 64 includes internal threads to receive a tube fastener 49. Tube fastener 49 is preferably a security bolt having a special head which receives a special wrench. The special wrench is used to turn tube fastener 49. A plug 62 inserts within socket 60. Plug 62 functions as a spacer and also abuts with a head portion of fastener 49 for a tight fitting when fastener is threaded within insert 64. Particularly, in one instance a tube 40 is inserted into a socket portion 60*b* such that tube 40 abuts one side of web 68. Plug 62 is placed within the opposite socket portion 60*a* such that plug 62 abuts an opposite side of web 68 (generally as shown in FIG. 6). Fastener 49 is then inserted through plug 62, through web passage 72 (web passage 72 runs through web 68) and into threads of threaded insert 64 located at end portion 66 of tube 40. Use of web 68 within socket 60 allows for tube 40 to be securely connected to base 24. Use of plug 62 also provides a snug fit and tightening surfaces so that fastener 49 is maintained in secured position without unwanted self-loosening.

Importantly, web 68 provides a user with certainty that a sufficient amount of tube 40 will be inserted into socket 60, and in order to maintain structural strength. For instance, when tube 40 abuts web 68, a person assembling bench 20 will know that a sufficient amount of tube has been inserted into socket 60, and when corresponding plug 62 and fastener 49 are used, tube 40 will be secured firmly against web 68. Further, and especially with respect to a sectional aspect of the bench 220 described below, use of web 68 will provide a person assembling the device with greater certainty that opposing tubes 40 are fully inserted into each of socket portion 60*a* and 60*b* or have a sufficient portion of each tube 40 secured within a socket 60. Particularly, when simultaneously placing opposing tubes 40 in sockets 60*a* and 60*b*, an assembler would not otherwise be able to see whether either or each of tubes 40 has been inserted fully or of a sufficient distance within a respective socket 60*a*, 60*b* in order to obtain a secure fastening. Yet with the socket design of this aspect, the person assembling bench 20 will be able to insert a threaded pin through web passage 72 and into threaded insert 64 of a first tube 40. The threaded pin will protrude from socket portion 60*a* thereby allowing the assembler to secure a second tube 40 onto base 24 by inserting threaded insert 64 onto the protruding threaded pin and turning the second tube 40 until second tube 40 abuts web 68. It will be appreciated that threaded insert 64 will have a thread depth that terminates at a thread base such that a threaded pin which is inserted within the threads of insert 64 can only be inserted to a depth equivalent to the thread base. For instance, the threads of threaded insert 64 may span and terminate at a depth of about 1½ inches to 2½ inches. In a case where the threads terminate at a depth of ½ inches, a threaded pin which is inserted into opposing tubes 40 and passes through web 68 of about ¾ inches will have a length of approximately 3¾ inches (or slightly less so that tubes 40 can be secured tightly (without "bottoming out") within each end of socket 60. Providing such structure eliminates uncertainty as to whether each of the tubes 40 has been sufficiently threaded and secured within the socket 60.

Figure 7:
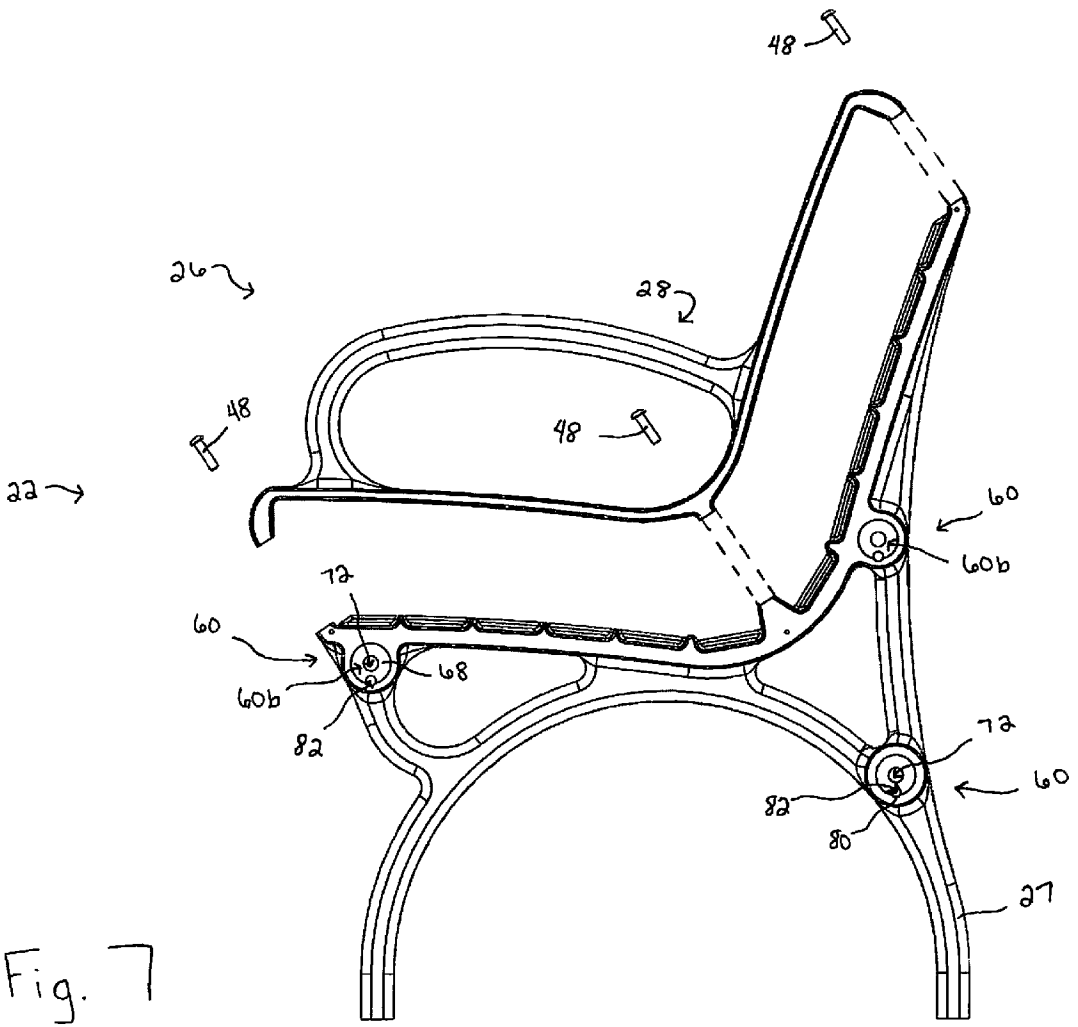
FIG. 7 is an exploded right side view of the support of FIG. 3.
Figure 9:
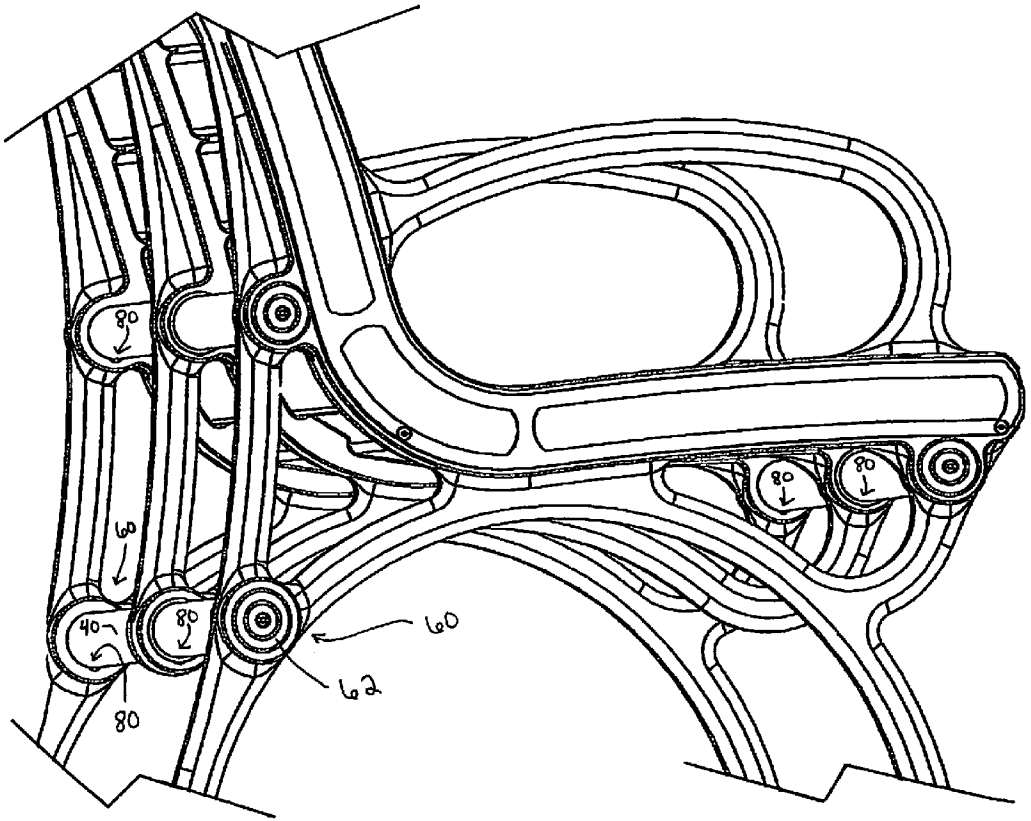
FIG. 9 is a partial rear perspective view of features of the bench of FIG. 1.

As shown in FIG. 6, socket 60 includes a vent channel 80. Channel 80 is defined in part by socket wall 70 and preferably spans the entire width of socket 60. Channel 80 runs through socket portion 60*a*, through web 68 at channel bore 82, and through socket portion 60*b* (pocket portion 60*b* may also be seen with reference to FIG. 7). It may be appreciated that socket wall 70 is substantially cylindrical having a generally circular inner diameter. In one aspect channel 80 may be configured as a half-circle, or partial cylinder, within wall 70 as shown in FIG. 6. Channel 80 provides a channel for the passage of matter therethrough. Thus, air and other gasses, liquids, water vapor, particles or materials may pass through socket 60. Vent channel 80 is especially important where a tube 40 is inserted within socket 60. Particularly, water vapor that is present and sealed within tube 40 would otherwise be trapped within tube 40 and not allowed to be released where tube 40 snugly abuts web 68. Channel bore 82 allows for air and vapor to escape or enter tube 40 through vent channel 80. Applicant appreciates that accumulation of water vapor and air within a confined space (such as within a closed tube 40) may result in condensation or unwanted moisture which over time causes deterioration of a structure or materials. With vent channel 80 and channel bore 82, air and vapor are allowed to freely enter or exit the tubes 40 and to adjust automatically with the conditions of the atmosphere. Accordingly, the inside portions of tubes 40 maintain a generally constant temperature and pressure with the atmosphere, thereby lessening stresses within or upon the structures otherwise caused by differences in pressure and temperature. Such venting structure also tends to lessen the loosening of parts of bench 20 such as fasteners 49 and tubes 40. As shown in FIG. 9, vent channel 80 is visible at an inside area of each socket 60. Where a plug 62 is inserted into an end of socket 60 opposite tube 40, even if plug 62 covers channel 80, it can be seen that channel 80 is nonetheless exposed on a side opposite the plug 62.

Figure 10:
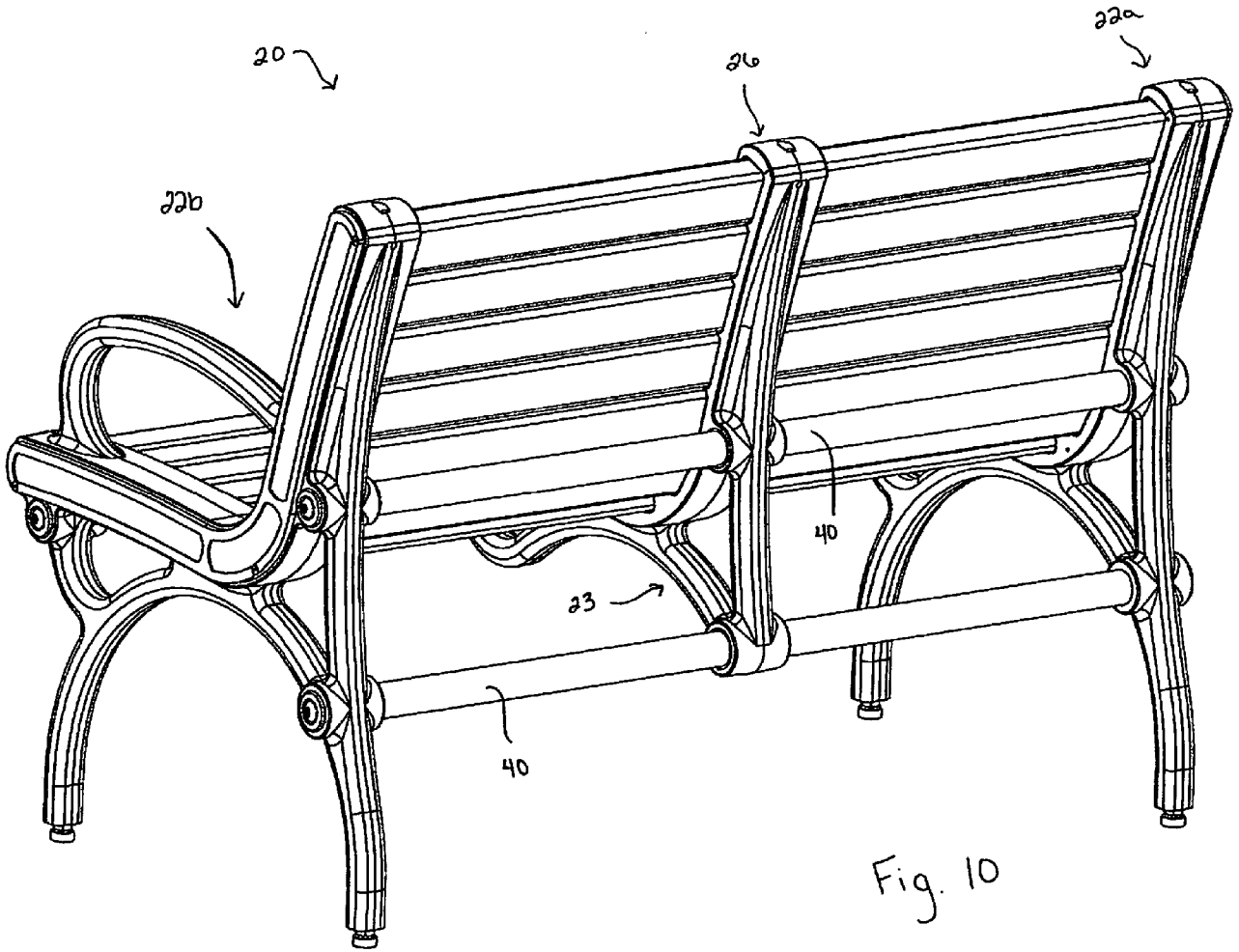
FIG. 10 is a rear perspective view of the bench of FIG. 1.
Figure 11:
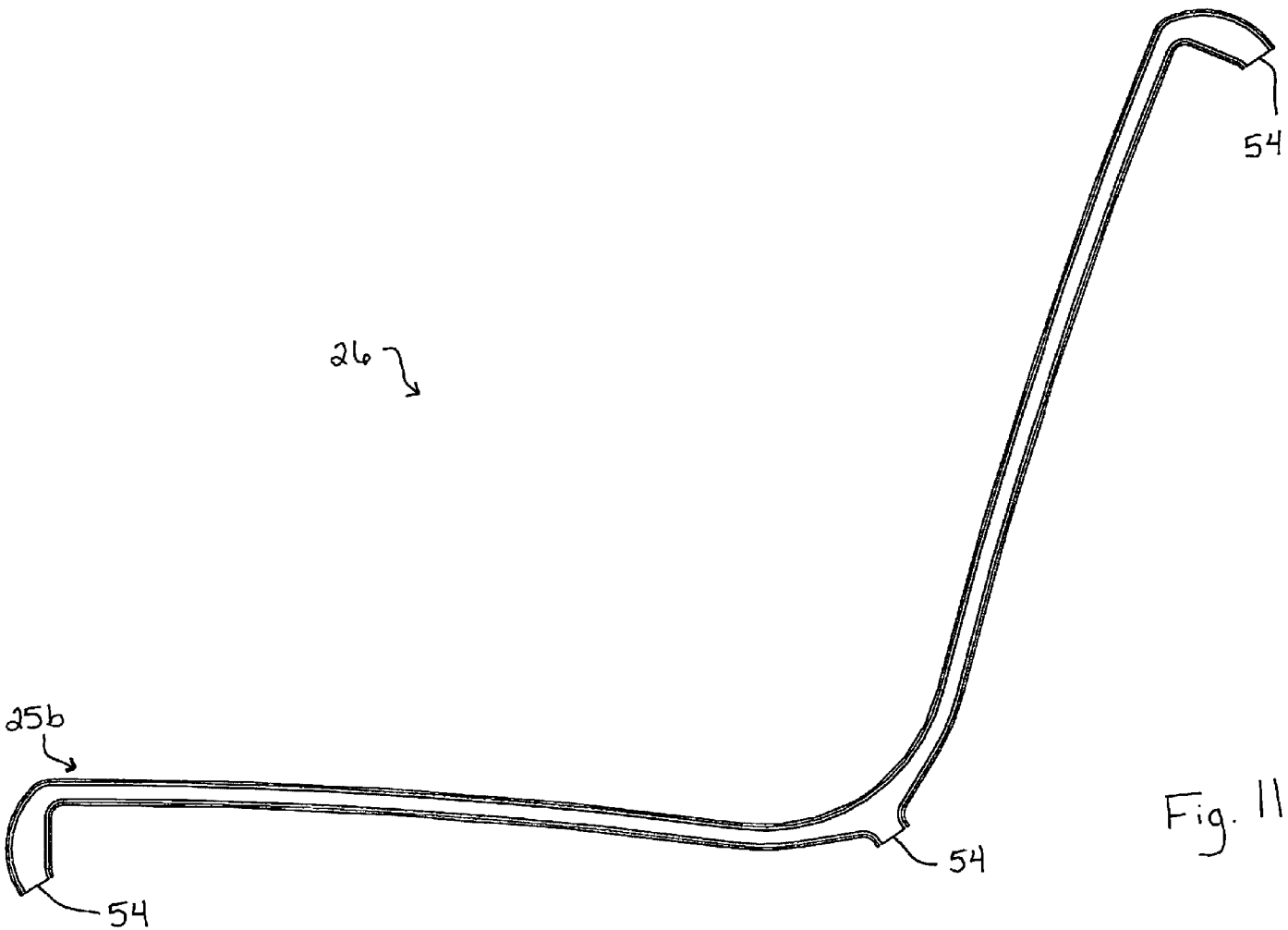
FIG. 11 is a side view of an alternative cap feature of the present invention.
Figure 12:
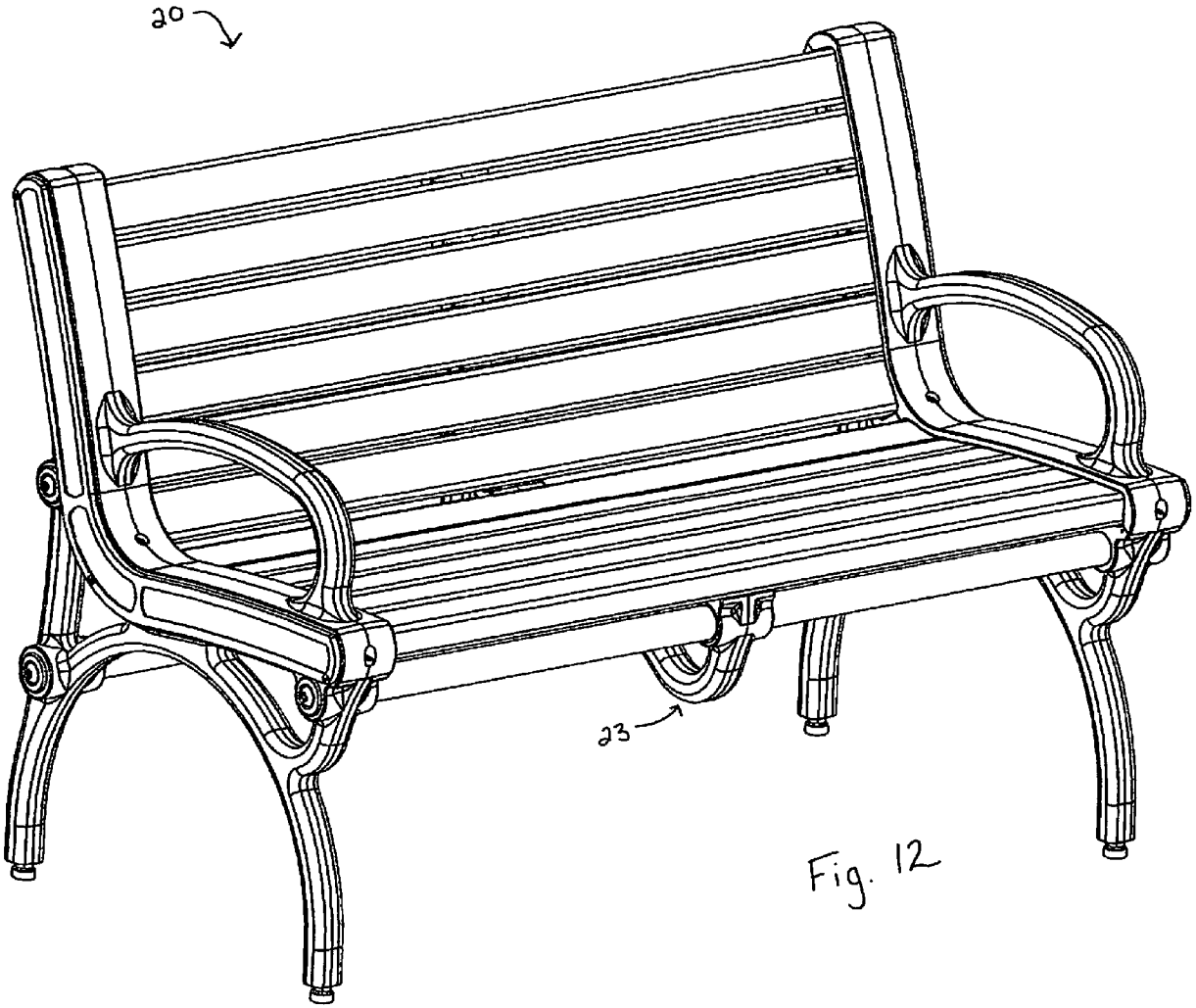
FIG. 12 is a perspective view of a bench according to an alternative aspect of the invention.
Figure 13:
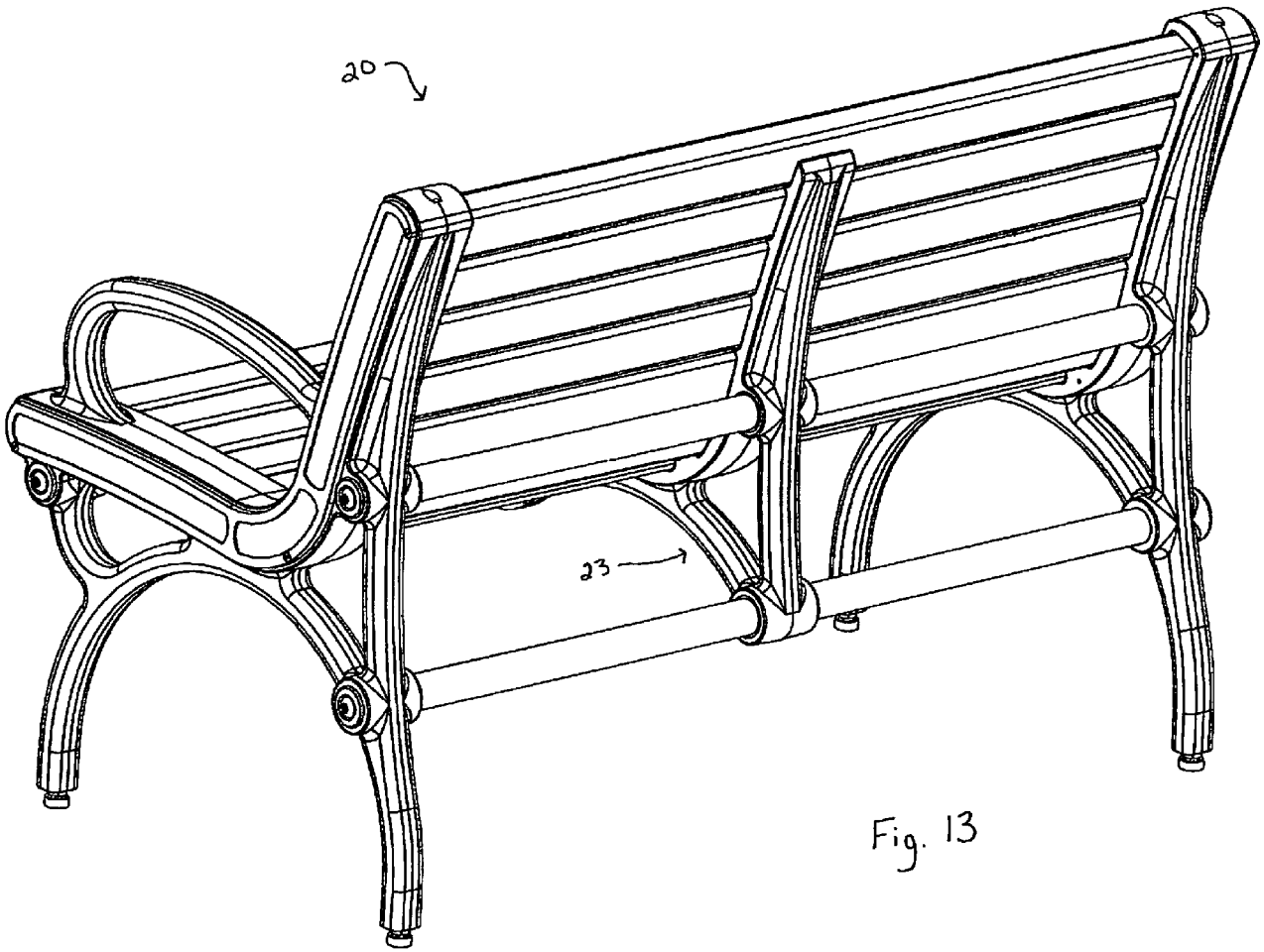
FIG. 13 is a rear perspective view of the bench of FIG. 12.
Figure 14:
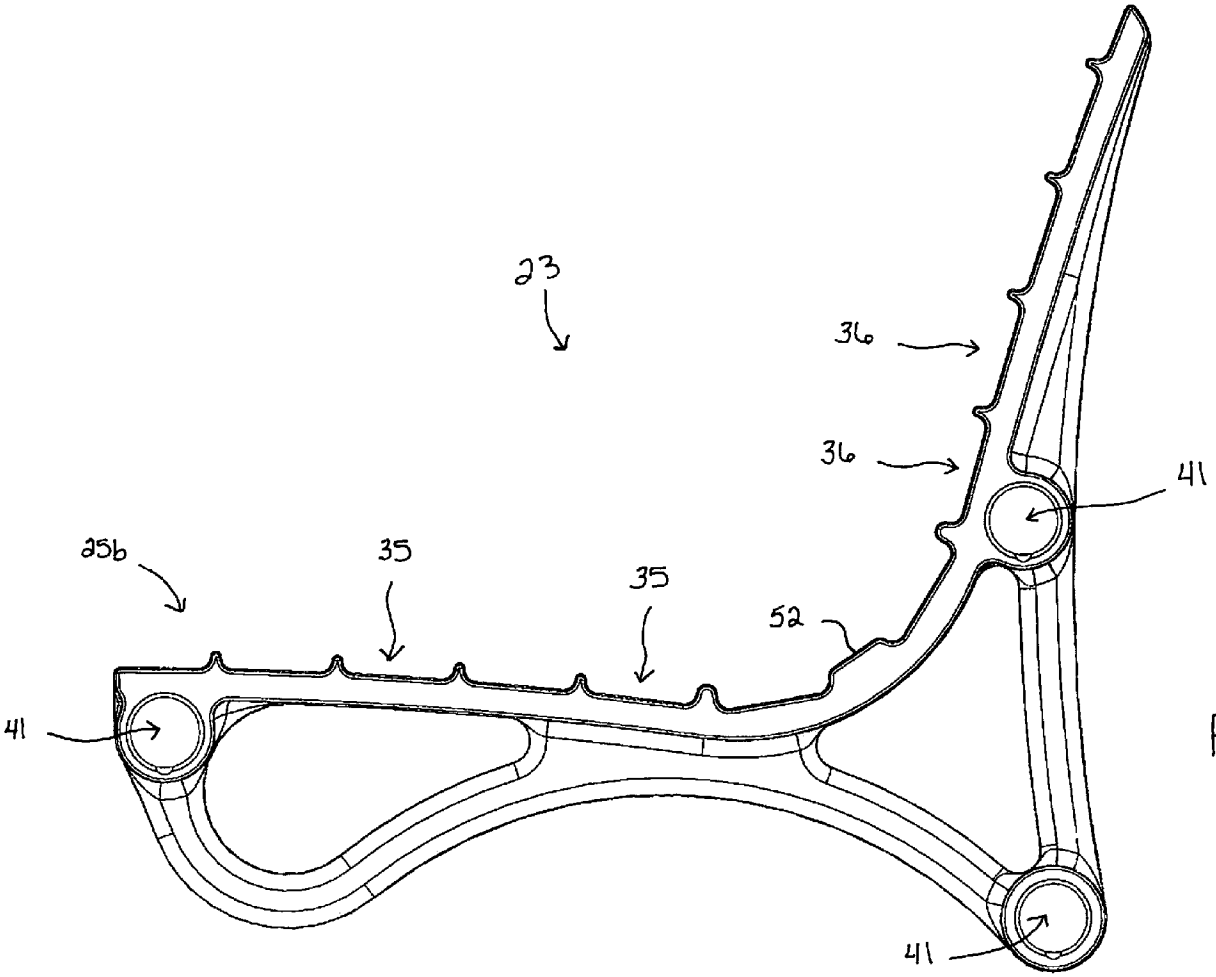
FIG. 14 is a side perspective view of an alternative base feature of the invention.

FIG. 10 is a rear perspective view of bench 20 shown in FIG. 1. Three tubes 40 separate supports 22*a*, 22*b*. Inside arm rest structure 38 is positioned generally at a middle area of bench 20. It may be appreciated that arm rest structure 38 may slide along tubes 40 in either direction. A set screw may optionally be used to secure structure 38 in position so that it does not slide about tubes 40 or planks 30. Arm rest structure 38 includes an inner base 23 which is also a pocket piece 25*b* defining in part holding pockets 35, 36 as similarly described above with respect to base 24. Base 23 defines bores 41 (See FIG. 14, for instance) through which tubes 40 insert or slide. Inner base 23 may also include vent channels 80 and vent structures corresponding to those used with sockets 60. A cap 26, which may or may not include an armrest 28 connects with base 23 to secure planks 30 within holding pockets 34, 36. Alternatively, cap 26 may be formed without an armrest 28. FIG. 11 shows a cap 26 that does not include an armrest but is generally flat. It may be appreciated that cap 26 of FIG. 11 may also be used as a cap in conjunction with base 24 to make supports 22. In further aspects as shown in FIG. 12, FIG. 13 and FIG. 14, a cap 26 is optional. In such case base 23 may be structured to receive tubes 40 yet not protrude or extend to receive a cap 26 (i.e., may lack flange 52). Note that support 38 does not include ribs 44. Avoiding ribs 44 allows for a single plank 30 to span across plank support face 42 of inside structure 38. It may be appreciated that an inside arm rest structure 38 is optional, yet may be preferred depending on the needs of use or the length of bench 20. Note that structure 38 does not include legs 27.

Figure 15:
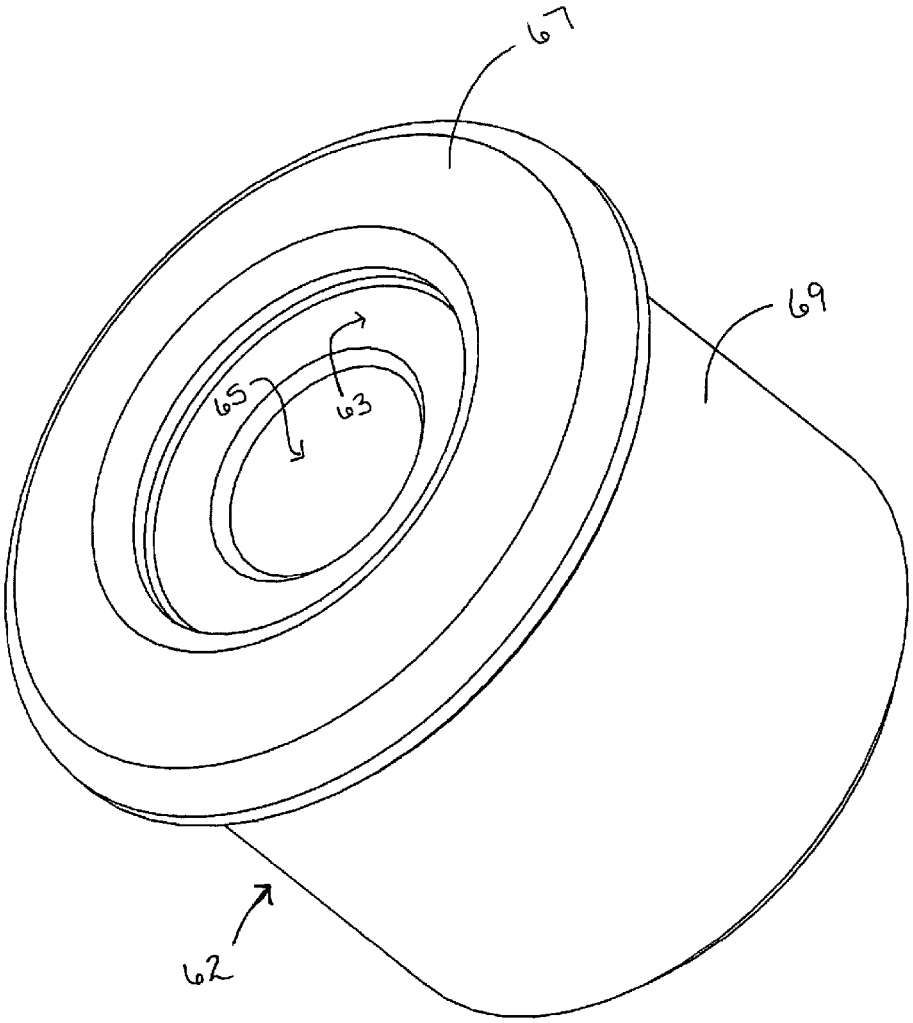
FIG. 15 is a perspective view of a feature component for use with the present invention.

Referring to FIG. 15, a plug 62 which may be inserted into socket 60 is shown. Plug 62 includes a recess 63 upon which a head of fastener 49 abuts. Fastener 49 passes through plug aperture 65. Plug 62 also includes rim 67 which extends over barrel 69. Rim 67 has an outer diameter greater than inner diameter of socket wall 70 such that rim 67 abuts socket wall 61 (See FIG. 6). Preferably vent channel 80 is nonetheless exposed to the atmosphere, at least slightly, even when plug 62 is placed within socket 60.

In operation, a user may conveniently remove the three fasteners 48 by use of a security wrench. Once the fasteners are removed, cap 26 may be lifted away from base 24. Cap 26 may include an armrest 28 or may alternatively comprise a flat cap 26 (See FIG. 11). If an optional end plate 56 has been secured to support 22*a*, the end plate 56 may first be removed by removing the plate screws 57. It may be appreciated that end plate 56 does not have to be removed in order to remove or slide the boards from bench 20. When end plate 56 is attached to base 24, the end portions 31 of the individual planks are completely surrounded by holding pockets 34, 36 and end plate 56. End plates 56 may be used for advertising or recognition or identification/insignia purposes and may be colored differently than the other components of bench 20 to provide accent or aesthetics as desired. End plate screws 57 insert through end plate 56 and into end plate screw port 58. Preferably screws or bolts 57 have a security head. Once cap 26 is lifted from base 24, the ends of planks 30 are exposed. An individual plank 30 may be lifted slightly to clear rib 44 and then pulled or slid away from opposing support 22*b*. Pulling or sliding plank 30 away from opposing support 22*b* will cause the plank 30 to be removed from a corresponding holding pocket 34, thus allowing plank 30 to be removed from bench 20. If optional inside armrest structure 38 is used, plank 30 may also slide within the holding pocket segments 35 (See FIG. 14). Alternatively, armrest structure 38 may be removed first by removing the three fasteners 48 and lifting cap 26 from inner base 23 (See FIG. 10 and FIG. 14). It may be appreciated that the planks 30 may slide through holding pocket segments 35 with no need to first remove cap 26 from inner base 23. Further still, cap 26 may also be removed from support 22*b* (in addition to or instead of removing cap 26 from support 22*a*). The plurality of planks 30 may then be easily lifted from bases 24. It may be appreciated that cap 26 is symmetrical such that it may be flipped upside down and still secured to base 24. In this manner the armrest 28 will also be flipped if desired so that the armrest is oriented generally vertically as opposed to the general horizontal orientation shown in the Figures.

Figure 16:
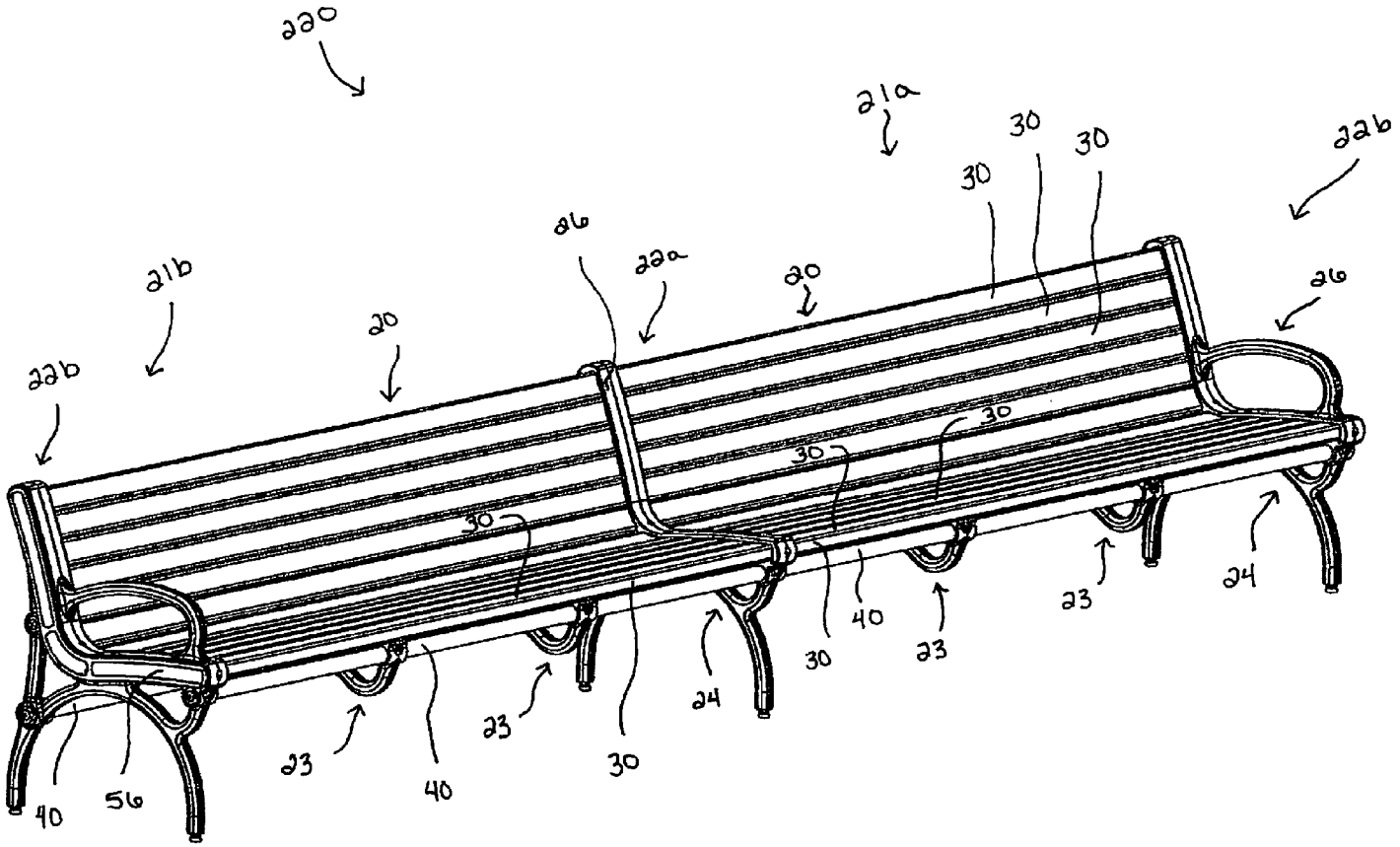
FIG. 16 is a perspective view of a further aspect of the invention depicting a sectional bench aspect.
Figure 11:
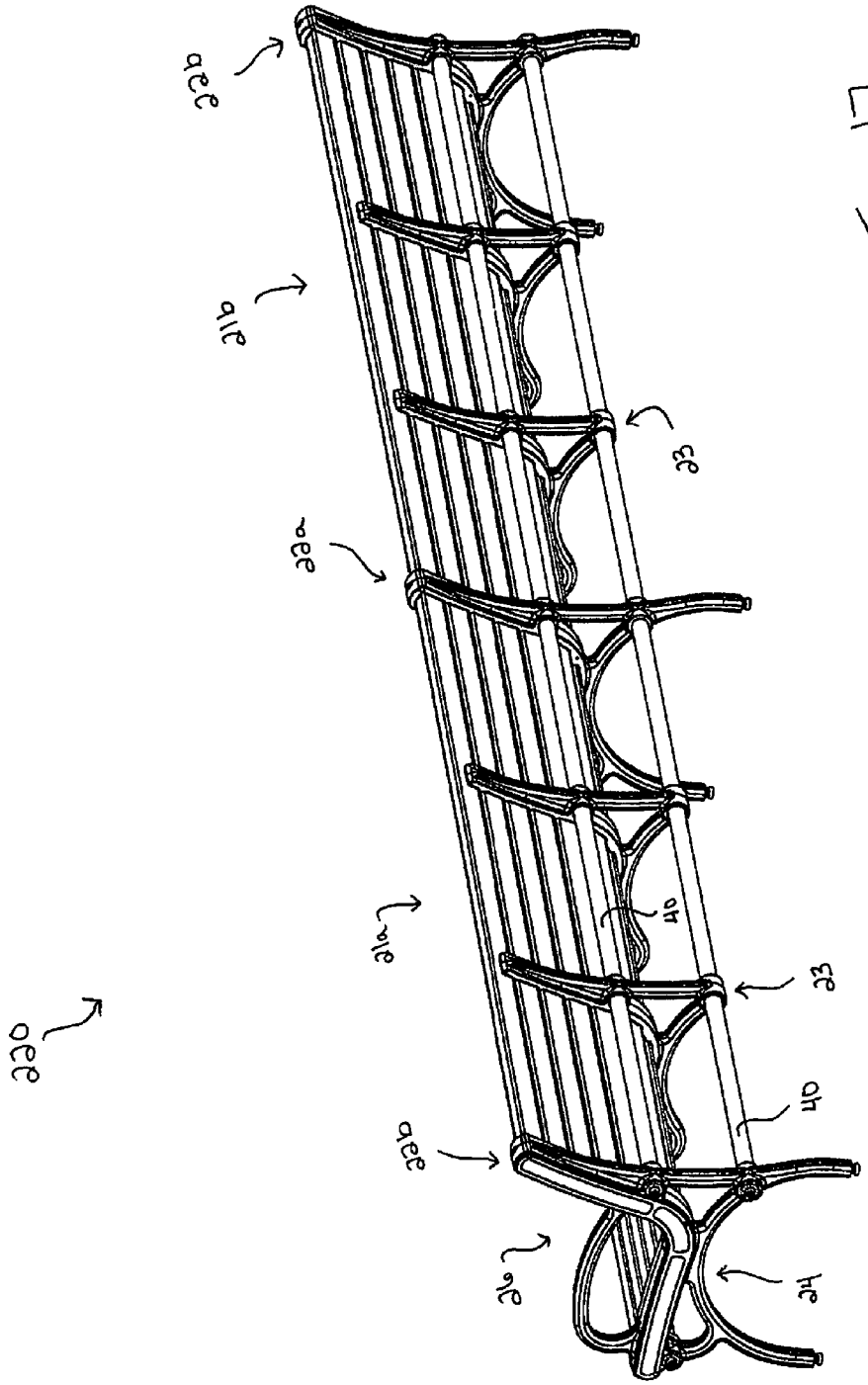

A sectional bench 220 is shown in FIG. 16 and FIG. 17. In this particular aspect, bench 220 includes two sections 21, each spanning about 8 feet in length to create a sixteen foot sectional bench 220. It may be appreciated that each section 21 can be considered a separate bench 20 as described above, and modified so that support 22*a* receives tubes 40 and planks 30 from both sides. Particularly, support 22*a* operates as a left side support 22 of bench 21*a* and as a right side support 22 of bench 21*b*. It may be appreciated that bench 21*a* is of the type described above regarding bench 20 with various optional features selected. For instance, section 21*a* uses planks 30 and tubes 40 that are about 8 feet in length. Cap 26 of support 22*a* is also a flat cap 26 such as that shown in FIG. 11. Also, an inner base support 23 is used in two locations between support 22*a* and support 22*b*. The alternate design of this aspect of the invention avoids use of the inner armrest structure. The inner base 23 of section 21*a* is similar to inner base 23 shown in FIG. 12. Alternatively, an inside armrest structure 38 as shown in FIG. 1 and FIG. 2 may be used with bench section 21*a*. Further, a cap 26 that does not include an armrest may also be used, however applicant believes the structure shown in FIG. 16 is preferred. Optionally, a series of inside armrest structures 38 may be used to create theater-type of seating where each seat enjoys armrests 38 on either side. Further, a series of inner bases 23 may be positioned between supports 22*a*, 22*b*. Such inner bases may conveniently slide onto tubes 40 and easily positioned by sliding along the tubes. Multiple inner bases 23 may be used for increased structural support as needed. Preferably bushings 33 (see FIG. 5) are placed over tubes 40 and positioned within bores 41 of inner base 23. As shown in FIG. 5, bushings 33 are slid along tube 40 for illustrative purposes. Preferably bushings 33 are nylon bushings that allow inner base 23 to slide along tubes 40 and vice versa. A set screw may be turned in order to hold base 23 in position relative to tubes 40. Bushings 33 may abut a web 39 (see FIG. 14) within bores 41 so that a bushing 33 is not allowed to slide all the way through bore 41. Bore 41 may also include a vent channel.

As may be appreciated, support 22*a* operates as a right-side support for bench section 21*b*. Support 22*a* has a base 24 as described above with respect to FIG. 3 and FIG. 4. Base 24 receives planks 30 at holding pockets 34 while also receiving planks 30 at holding pockets 34' which extend opposite the planks 30 at holding pockets 34. In one aspect it may be appreciated that planks 30 inserted within holding pockets 34 do not abut planks 30 that are inserted within holding pockets 34'. Instead the respective planks 30 may abut against respective end ribs 44. A flat cap 26 is placed on top of and secured to base 24 to create the respective pockets 34, 34' as described above. Tubes 40 insert into either side of sockets 60. Particularly, a tube 40 may insert into a first socket portion 60*a* and abut against web 68 (see FIG. 6) while a second tube 40 may insert into a second socket portion 60*b* and abut against web 68. The first tube 40 would not abut against the second tube 40. In this manner support 22*a* operates as a support for both bench section 21*a* and bench section 21*b*. Bench section 21*b* includes inner base 23 for added structural support. Optionally, inside armrest structure 38 may also be used instead of either or both inner bases 23. Additional inner bases 23 or armrest structures 38 may also be included in each bench section 21 as desired. For added support, inner base 23 could also be configured with legs 27.

It may be appreciated that supports 22*b* (either or both) as shown in FIG. 16 can also be used or transformed into "inner" supports 22*a* as shown in FIG. 16. Particularly, optional end plate 56 of support may be removed so that holding pockets 34 are exposed. Alternatively, or in addition to removal of end plate 56, cap 26 may be removed to expose plank support faces 42. Removal of cap 26 may be accomplished swiftly by removing the fastener(s) 48 which are preferably security head bolts. Also, plugs 62 may be removed so that sockets 60 are exposed. To remove the plugs 62 the tube fastener 49 is unscrewed. A replacement fastener may then be inserted into the threaded insert 64 of tube 40 on one end of socket 60 and into a threaded insert 64 of another tube 40 on another end of socket 60. Thereafter planks 30 may be inserted into holding pockets 34 and tubes 40 may be inserted into sockets 60 so that an additional section 21*c* (not shown) can be added on to sectional bench 220. Another support 22*b* can be added to the outside end of the bench 220 to support the opposite end of the added tubes 40 and planks 30. The same transformation may be repeated indefinitely so that any length of sectional bench 220 may be created. It may be appreciated that long benches of 24 feet or even extremely long benches of several hundred feet in length, or more, may be modularly assembled. Such long benches may also be shortened by removing particular bench sections 21. It may be appreciated that end supports 22*b* may include an armrest 28 or utilize a flat cap 26. The additional section 21*c* can have planks 30 and tubes 40 of varying lengths. Bench 20 and sectional bench 220 is modular in that additional identical components, such as supports 22, planks 30 and tubes 40 may be connected to respective components to form expanded bench sections 21 that connect together. Further, the artistic style of supports and the legs 27 may vary to provide various themes for a classical, Victorian or other styles as desired.

Bench 20 and sectional bench 220 may also include an end table component. End table component is configured to connect to bench 20 at support 22*a* or 22*b*. End table may comprise a base similar to base 24 together with a table that extends between the supports 22. End table allows for modular extension of bench sections 21 at a variety of angles. For instance, end table may be positioned between adjacent sections 21 so that sections 21 are oriented at 90 degree angles. Section bench 220 may then be configured in a 90 degree orientation. End table may operate as either an end table or as a corner or angle-point for extension of sectional modules. End table may be flanked by and connected to bench 20 and sectional bench 220. End table may include an angle piece to accommodate extensions that project from the base bench 20 at angles of 45 degrees, 30 degrees, etc. Such end table may accommodate orientations allowing section bench 20 to wrap around buildings, trees, fountains, or other objects, or wind or curve along curved paths and to fit within corners of rooms or along corners or exterior walls, etc. For instance, one side of end table may be connected to section bench 220 and another side of end table may be connected to bench 20. If end table provides for a 90 degree connection, the resulting section bench 20 will include the same 90 degree turn suitable for placing the bench in a corner. Other angled orientations may be made with variations to the angle chosen for end table. Preferably end table has sockets 60 that correspond to sockets 60 of bench 20 such that tubes 40 or even angled tubes may connect respective sockets 60 in order to connect end table to bench 20.

Removing cap 26 from bench 20 or sectional bench 220 also easily allows for an individual plank 30 to be removed from bench 20 or sectional bench 220 without having to move, hold or remove any other plank 30. Thus, the bench 20 may be easily changed, maintained or repaired where only a single plank 30 requires attention and without moving any other of the planks 30 and also without having to remove or hold a base 24.

As shown in FIG. 5, feet 90 may be provided at an end of legs 27. A screw jack or threaded insert bolt 88 may insert into a threaded end of leg 27. A threaded insert 64 may be inserted into the end of leg 27 to receive the threaded insert bolt 88 as may be appreciated. A slider 86 may be attached to bolt 88 by use of a foot bolt 84 which threads into the head of bolt 88. Slider 86 may be made of plastic and may include, for instance, material such as high molecular weight polyethylene. Preferably the top or head of bolt 88 has a hex configuration for easy or convenient adjustment as needed. Preferably all hardware such as feet 90, fasteners 48, 49, end plate screws 57, and inserts 64 are made of stainless steel. Preferably tubes 40 are made of steel and powder coated.

In an alternative aspect, supports 22' may include a base 24 that lacks legs 27. Such support and base may be used, for instance, as an end support for a swing. Particularly, such alternative supports 22' can be connected to a rope or chain and suspended from an overhanging structure to create a swinging bench.

It should be understood, of course, that the foregoing relates to exemplary embodiments of the invention and that modifications may be made without departing from the spirit and scope of the invention as set forth in the following claims.

What is claimed is:

1. A sitting bench comprising:

at least a first support for holding planks to be used in said bench, said at least first support including a base having ground contacting legs connected to and extending downward from said base, said base having a first pocket piece in part defining a plurality of holding pockets configured to receive ends of the planks, said holding pockets further defined at least in part by a second pocket piece comprising a detachable cap positioned above said first pocket piece, said cap having a width substantially greater than at least half a width of said support, at least a portion of said plurality of holding pockets are generally oriented along a seating plane and at least a portion of said plurality of holding pockets are generally oriented along a backrest plane oriented at an obtuse angle with respect to said seating plane.

2. The bench of claim 1 where said cap includes an armrest extending upward from said second pocket piece opposite said first pocket piece.

3. The bench of claim 1 further comprising at least one tube extending between said at least a first support and a second support.

4. The bench of claim 1 further comprising at least one tube extending between said at least a first support and a second support, said second support having a holding pocket configured to receive an opposite end of the plank, said holding pocket defined by a first pocket piece and a second pocket piece.

5. The bench of claim 1 where said holding pocket is further defined at least in part by a plank support face and a rib projecting upward from said support face.

6. The bench of claim 5 where said support face is oriented on an upper surface of said first pocket piece, said rib oriented generally along a longitudinal central axis of said first pocket piece.

7. The bench of claim 1 where said first pocket piece and said second pocket piece define said plurality of holding pockets for receiving and surrounding end portions of planks to be used in said bench, said first pocket piece and said second pocket piece are detachably connected and define a seating pocket segment generally oriented along a seating plane and further define a backrest pocket segment generally oriented along a backrest plane, said backrest plane generally oriented at an obtuse angle with respect to said seating plane.

8. The bench of claim 1 where at least a portion of a terminal end of at least one of the planks is visible when said cap is secured to said support.

9. A sitting bench comprising:

at least a first support for holding a plank to be used in said bench, said at least first support having ground contacting legs connected to and extending downward from said first support, said first support having a holding pocket configured to receive an end of the plank, said holding pocket defined by a first pocket piece and a second pocket piece where said holding pocket is configured to receive the plank on a first side of said support where the plank extends away from said support in a first direction and where said holding pocket is configured to simultaneously receive another plank on a second opposite side of said support where the another plank extends away from the plank in a second direction, the second direction being opposite the first direction.

10. A sitting bench comprising:

at least a first support for holding at least one plank to be used in said bench, said support comprising:

a base having a seat portion and a back portion, said back portion raised with respect to said seat portion; and a cap removably connected to said base, said cap configured to substantially cover said seat portion and said back portion, said cap and said seat portion and said back portion defining a plurality of holding pockets for receiving planks to be used in said bench, said back portion connected to said seat portion at a generally obtuse angle with respect to said seat portion.

11. The bench of claim 10 further comprising at least one plank and a second support for holding said at least one plank in said bench, said second support comprising:

a base having a base pocket portion; and a cap removably connected to said base, said cap and said base pocket portion defining a plurality of holding pockets for receiving planks to be used in said bench, said at least one plank extending from one of said plurality of holding pockets of said first support to at least one of said plurality of holding pockets of said second support.

12. The bench of claim 11 further comprising at least one tube extending from said at least a first support to said second support and an inside armrest structure receiving said tube.

13. The bench of claim 11 further comprising at least three tubes extending from sockets defined by said at least a first support to sockets defined by said second support and a plurality of planks positioned in respective said plurality of holding pockets of said first support extending to respective of said plurality of holding pockets of said second support.

14. The bench of claim 10 where said support is configured to receive a first plank extending from a first side of one of said plurality of holding pockets and a second plank extending from a second side of said one of said plurality of holding pockets.

15. The bench of claim 10 where said back portion is integrally connected to said seat portion.

16. The bench of claim 10 where said cap includes a seat portion and a back portion, said back portion of said cap raised at a generally obtuse angle with respect to said seat portion of said cap.

17. A sitting bench comprising:

at least a first support for holding at least one plank to be used in said bench, said support comprising:

a base having a base pocket portion; and a cap removably connected to said base, said cap and said base pocket portion defining a plurality of holding pockets for receiving planks to be used in said bench where said base includes at least one socket for receiving a tube spanning from said base to a second base, said socket including a vent channel defined by a wall of said socket, said vent channel spanning a width of said socket.

18. A sitting bench comprising:

at least a first support for holding at least one plank to be used in said bench, said support comprising:

a base having a base pocket portion; and a cap removably connected to said base, said cap and said base pocket portion defining a plurality of holding pockets for receiving planks to be used in said bench where said base includes at least one generally cylindrical socket for receiving a tube spanning from said base to a second base, said socket including an internal web, said web and a wall of said socket defining a first socket portion and a second socket portion opposite said first socket portion, said first socket portion configured to receive a tube which extends between said base and said second base.

19. A sitting bench comprising:

at least a first support for holding at least one plank to be used in said bench, said support comprising:

a base having a base pocket portion;

at least one ground contacting leg connected to and extending downward from said base; and a cap removably connected to said base, said cap and said base pocket portion defining a plurality of holding pockets for receiving planks to be used in said bench and further comprising an end plate removably connected to said base and in part defining said plurality of holding pockets for receiving planks to be used in said bench.

20. The bench of claim 19 where said base includes a seat portion and a back portion extending upward from said seat portion, said end plate covering holding pockets defined by said seat portion and said back portion.

21. The bench of claim 19 where said end plate is oriented transverse a longitudinal axis of the at least one plank.

22. A method of removing a plank from a bench having a plurality of planks extending from a first support having ground contacting legs to a second support having ground contacting legs, at least one of the supports having a cap detachably connected to a base where the cap and the base define a plurality of holding pockets for holding the respective plurality of planks, at least a portion of the plurality of holding pockets are generally oriented along a seating plane and at least a portion of the plurality of holding pockets are generally oriented along a backrest plane oriented at an obtuse angle with respect to the seating plane, the cap in part defining a portion of the holding pockets oriented along the seating plane and oriented along the backrest plane, said method comprising:

removing the cap; and removing the plank while the remaining of the plurality of planks remain undisturbed.

* * * * *